US009718527B2

(12) United States Patent
Ito

(10) Patent No.: US 9,718,527 B2
(45) Date of Patent: Aug. 1, 2017

(54) ACCELERATION CONTROL SYSTEM FOR MARINE VESSEL

(71) Applicant: YAMAHA HATSUDOKI KABUSHIKI KAISHA, Iwata-shi, Shizuoka (JP)

(72) Inventor: Makoto Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/003,821

(22) Filed: Jan. 22, 2016

(65) Prior Publication Data

US 2016/0280351 A1 Sep. 29, 2016

(30) Foreign Application Priority Data

Mar. 26, 2015 (JP) ..... 2015-064113

(51) Int. Cl.
*B63H 21/21* (2006.01)
*B63B 35/81* (2006.01)
*B63H 20/00* (2006.01)

(52) U.S. Cl.
CPC ..... *B63H 21/21* (2013.01); *B63B 35/815* (2013.01); *B63H 2020/003* (2013.01); *B63H 2021/216* (2013.01)

(58) Field of Classification Search
CPC ..... B60L 15/00; B63H 25/10
See application file for complete search history.

(56) References Cited

U.S. PATENT DOCUMENTS 5,142,473 A * 8/1992 Davis ..... B63B 39/14 440/1
7,214,110 B1 5/2007 Ehlers et al.
7,305,928 B2 * 12/2007 Bradley ..... B63H 25/42 114/144 A
7,361,067 B1 4/2008 Smedema
8,190,316 B2 * 5/2012 Kaji ..... B63H 21/213 318/588
2003/0003822 A1 * 1/2003 Kaji ..... B63H 21/213 440/84
2005/0263058 A1 * 12/2005 Suemori ..... B63H 21/22 114/144 R
2008/0167766 A1 * 7/2008 Thiyagarajan ..... B61L 3/006 701/19
2008/0167767 A1 * 7/2008 Brooks ..... B61L 3/006 701/20
2009/0118970 A1 * 5/2009 Daum ..... B61L 3/006 701/102

(Continued)

*Primary Examiner* — Jonathan M Dager
*Assistant Examiner* — Alex C Dunn
(74) *Attorney, Agent, or Firm* — Keating and Bennett, LLP

(57) ABSTRACT

An acceleration control system for a marine vessel includes an actual propulsion power detector, a setting controller configured or programmed to set final target propulsion power of the marine vessel, and a controller. The controller is configured or programmed to set target propulsion power of the marine vessel at an initial time to an initial target propulsion power, to change the target propulsion power of the marine vessel based on an actual propulsion power of the marine vessel and the initial target propulsion power, and to control a propulsion device such that the actual propulsion power of the marine vessel gets closer to the final target propulsion power.

17 Claims, 5 Drawing Sheets

(56) References Cited

U.S. PATENT DOCUMENTS

| | | | | |
|---|---|---|---|---|
| 2011/0215641 | A1* | 9/2011 | Peterson | H01H 11/00 307/23 |
| 2012/0303237 | A1* | 11/2012 | Kumar | B61L 3/006 701/93 |
| 2015/0127197 | A1* | 5/2015 | Lindeborg | B63H 25/02 701/21 |
| 2016/0259356 | A1* | 9/2016 | Converse | G05B 15/02 |

* cited by examiner

ACCELERATION LEVEL SETTING

| ACCELERATION LEVEL | INITIAL TARGET VESSEL SPEED (RATIO TO FINAL TARGET VESSEL SPEED) | INTERMEDIATE TARGET VESSEL SPEED (RATIO TO FINAL TARGET VESSEL SPEED) | INCREASED VALUE (INCREASED AMOUNT PER SECOND) |
|---|---|---|---|
| LOW | 0.7 | 0.9 | 1.5 mph/s |
| MIDIUM | 1.0 | 0.85 | 1.0 mph/s |
| HIGH | 1.5 | 0.8 | 0.75 mph/s |

SECOND PREFERRED EMBODIMENT

ACCELERATION CONTROL SYSTEM FOR MARINE VESSEL

CROSS-REFERENCE TO RELATED APPLICATION

This application claims priority to Patent Application No. 2015-064113 filed in Japan on Mar. 26, 2015, the entire contents of which are hereby incorporated by reference.

BACKGROUND OF THE INVENTION

1. Field of the Invention

The present invention relates to an acceleration control system for a marine vessel.

2. Description of the Related Art

An acceleration control system for a marine vessel is known in general. Such an acceleration control system for a marine vessel is disclosed in U.S. Pat. No. 7,214,110 and U.S. Pat. No. 7,361,067, for example.

U.S. Pat. No. 7,214,110 discloses an acceleration control system for a marine vessel including an engine, a throttle mechanism that manipulates the output of the engine, and a microprocessor that controls the acceleration of the marine vessel. The microprocessor of the acceleration control system prepares an acceleration profile as a function of time by setting a target rotational speed, an acceleration rate, an overshoot rate, and an overshoot period and controls the acceleration based on the prepared acceleration profile.

U.S. Pat. No. 7,361,067 discloses an acceleration control system for a marine vessel including an engine, a throttle device that manipulates the output of the engine, and a microprocessor that controls the acceleration of the marine vessel. The microprocessor of the acceleration control system learns and stores an actual acceleration profile of the marine vessel and controls the rotational speed of the engine based on the stored acceleration profile.

In the acceleration control system for a marine vessel according to each of U.S. Pat. No. 7,214,110 and U.S. Pat. No. 7,361,067, however, the acceleration state becomes different from the prepared or learned acceleration profile even when the acceleration is controlled based on the prepared or learned acceleration profile. Thus, it is difficult to maintain a stable acceleration state.

SUMMARY OF THE INVENTION

Preferred embodiments of the present invention provide an acceleration control system for a marine vessel that maintains a stable acceleration state.

An acceleration control system for a marine vessel according to a first preferred embodiment of the present invention includes an actual propulsion power detector that detects an actual value of propulsion power including the rotational speed of a propulsion device of the marine vessel or the speed of the marine vessel, a setting controller configured or programmed to set a final target propulsion power of the marine vessel, and a controller configured or programmed to calculate a target propulsion power of the marine vessel and to control the propulsion device based on the target propulsion power. The controller is configured or programmed to set the target propulsion power of the marine vessel at an initial time to an initial target propulsion power, to change the target propulsion power of the marine vessel based on an actual propulsion power of the marine vessel and the initial target propulsion power, and to control the propulsion device such that the actual propulsion power of the marine vessel gets closer to the final target propulsion power.

The acceleration control system for a marine vessel according to the first preferred embodiment of the present invention is provided with the controller configured or programmed to set the target propulsion power of the marine vessel at the initial time to the initial target propulsion power, to change the target propulsion power of the marine vessel based on the actual propulsion power of the marine vessel and the initial target propulsion power, and to control the propulsion device such that the actual propulsion power of the marine vessel gets closer to the final target propulsion power. Thus, the target propulsion power is set to the initial target propulsion power in the early stage of acceleration, and hence the marine vessel is promptly accelerated. Furthermore, the target propulsion power of the marine vessel is changed based on the actual propulsion power of the marine vessel and the initial target propulsion power such that the influences of waves, wind, etc. changing from moment to moment are reflected in the target propulsion power based on the actual propulsion power, and hence a stable acceleration state is maintained.

In the acceleration control system for a marine vessel according to the first preferred embodiment of the present invention, the controller is preferably configured or programmed to set the initial target propulsion power based on the final target propulsion power. Accordingly, the initial target propulsion power in the early stage of acceleration is set based on the final target propulsion power, and hence the marine vessel is smoothly accelerated in the early stage of acceleration.

In this case, the controller is preferably configured or programmed to set the initial target propulsion power to about ⅓ or more, for example, of the final target propulsion power. Accordingly, the initial target propulsion power in the early stage of acceleration is preferably set to about ⅓ or more, for example, of the final target propulsion power, and hence a reduction in the acceleration in the early stage of acceleration is significantly reduced or prevented such that the marine vessel is promptly accelerated.

The acceleration control system for a marine vessel according to the first preferred embodiment of the present invention preferably further includes an accelerator that is manipulated to adjust the propulsion power of the marine vessel, and the controller is preferably configured or programmed to control acceleration of the marine vessel and to set the initial target propulsion power to a value larger than propulsion power corresponding to a threshold in a normal mode, when the accelerator is operated not less than the threshold in an acceleration mode. Accordingly, the accelerator is operated not less than the threshold such that the marine vessel easily starts to be accelerated in the acceleration mode and is promptly accelerated in the early stage of acceleration by setting the initial target propulsion power in the early stage of acceleration to the value larger than the propulsion power corresponding to the threshold.

In the acceleration control system for a marine vessel according to the first preferred embodiment of the present invention, the initial target propulsion power is preferably adjusted according to an acceleration level. Accordingly, when a user sets the acceleration level to be high, the initial target propulsion power in the early stage of acceleration is increased, and hence the marine vessel is more promptly accelerated. When the user sets the acceleration level to be low, the initial target propulsion power in the early stage of acceleration is decreased, and hence the marine vessel is relatively slowly accelerated. Consequently, when the marine vessel tows water skis, a wakeboard, or the like, for example, the acceleration level is properly set such that the marine vessel is accelerated and tows a water skier or wakeboarder according to a level desired by the water skier or wakeboarder.

In the acceleration control system for a marine vessel according to the first preferred embodiment of the present invention, the controller is preferably configured or programmed to change the target propulsion power based on the actual propulsion power of the marine vessel, the initial target propulsion power, and the final target propulsion power. Accordingly, the target propulsion power of the marine vessel is changed based on the actual propulsion power of the marine vessel, the initial target propulsion power in the early stage of acceleration, and the final target propulsion power such that a more stable acceleration state is maintained regardless of the influences of waves, wind, etc. changing from moment to moment.

In this case, the controller is preferably configured or programmed to set an intermediate target propulsion power to less than the final target propulsion power based on the final target propulsion power and to change the target propulsion power based on the actual propulsion power of the marine vessel, the initial target propulsion power, and the intermediate target propulsion power. Accordingly, the target propulsion power is changed also based on the intermediate target propulsion power, which is less than the final target propulsion power, such that the possibility that the actual propulsion power of the marine vessel becomes excessively larger than (overshoots) the final target propulsion power is significantly reduced or prevented, and hence the propulsion power of the marine vessel smoothly shifts to the final target propulsion power. Consequently, when the marine vessel tows water skis, wakeboards, or the like, for example, deceleration of the marine vessel after overshoot of the propulsion power of the marine vessel from the final target propulsion power is significantly reduced or prevented, and hence a release of tension on the towed water skier or wakeboarder is significantly reduced or prevented.

In the structure in which the intermediate target propulsion power is set based on the final target propulsion power, the controller is preferably configured or programmed to change the target propulsion power such that the actual propulsion power of the marine vessel and the target propulsion power intersect with each other at the intermediate target propulsion power. Accordingly, overshoot of the actual propulsion power of the marine vessel from the final target propulsion power is significantly reduced or prevented.

In this case, the controller is preferably configured or programmed to change the target propulsion power such that a ratio of a difference between the intermediate target propulsion power and the initial target propulsion power to the intermediate target propulsion power is equal or substantially equal to a ratio of a difference between the target propulsion power and the initial target propulsion power to the actual propulsion power of the marine vessel. Accordingly, the actual propulsion power of the marine vessel and the target propulsion power are easily made to intersect with each other at the intermediate target propulsion power.

In the structure in which the intermediate target propulsion power is set based on the final target propulsion power, the controller is preferably configured or programmed to change the target propulsion power based on the final target propulsion power after the actual propulsion power of the marine vessel reaches the intermediate target propulsion power. Accordingly, the marine vessel is smoothly accelerated until the actual propulsion power of the marine vessel reaches the final target propulsion power after reaching the intermediate target propulsion power.

In the structure in which the intermediate target propulsion power is set based on the final target propulsion power, the intermediate target propulsion power is preferably adjusted according to an acceleration level. Accordingly, when the user sets the acceleration level to be high, for example, the intermediate target propulsion power is decreased such that overshoot of the actual propulsion power of the marine vessel from the final target propulsion power is significantly reduced or prevented, and when the user sets the acceleration level to be low, for example, the intermediate target propulsion power is increased such that the marine vessel is relatively slowly and smoothly accelerated.

The acceleration control system for a marine vessel according to the first preferred embodiment of the present invention preferably further includes an accelerator that is manipulated to adjust the propulsion power of the marine vessel, and the controller is preferably configured or programmed to compare a first target propulsion power corresponding to an operation of the accelerator with a second target propulsion power calculated based on the actual propulsion power of the marine vessel and to select a smaller value of the first target propulsion power and the second target propulsion power as the target propulsion power. Accordingly, when wishing to stop the acceleration of the marine vessel halfway, the user easily stops the acceleration of the marine vessel by operating the accelerator to make the first target propulsion power smaller than the second target propulsion power.

In the acceleration control system for a marine vessel according to the first preferred embodiment of the present invention, the final target propulsion power is preferably set by a user. Accordingly, the user sets the final target propulsion power according to the situation, and the marine vessel is smoothly accelerated to the set final target propulsion power.

An acceleration control system for a marine vessel according to a second preferred embodiment of the present invention includes an actual propulsion power detector that detects the actual value of propulsion power including the rotational speed of a propulsion device of the marine vessel or the speed of the marine vessel, a setting controller configured or programmed to set final target propulsion power of the marine vessel, and a controller configured or programmed to calculate target propulsion power of the marine vessel and to control the propulsion device based on the target propulsion power. The controller is configured or programmed to set an intermediate target propulsion power to less than the final target propulsion power based on the final target propulsion power, to set the target propulsion power based on the intermediate target propulsion power until an actual propulsion power of the marine vessel reaches the intermediate target propulsion power, and to set the target propulsion power based on the final target propulsion power after the actual propulsion power of the marine vessel reaches the intermediate target propulsion power.

The acceleration control system for a marine vessel according to the second preferred embodiment of the present invention is provided with the controller configured or programmed to set the intermediate target propulsion power to less than the final target propulsion power based on the final target propulsion power, to set the target propulsion power based on the intermediate target propulsion power until the actual propulsion power of the marine vessel reaches the intermediate target propulsion power, and to set the target propulsion power based on the final target propulsion power after the actual propulsion power of the marine vessel reaches the intermediate target propulsion power. Thus, the target propulsion power is set based on the intermediate target propulsion power less than the final target propulsion power such that the possibility that the actual propulsion power of the marine vessel becomes excessively larger than (overshoots) the final target propulsion power is significantly reduced or prevented. Therefore, the marine vessel is promptly accelerated, and the propulsion power of the marine vessel smoothly shifts to the final target propulsion power. Thus, stable acceleration state is maintained regardless of the influences of waves, wind, etc. changing from moment to moment.

In the acceleration control system for a marine vessel according to the second preferred embodiment of the present invention, the controller is preferably configured or programmed to set the intermediate target propulsion power to about ½ or more, for example, of the final target propulsion power. Accordingly, the intermediate target propulsion power is preferably set to about ½ or more, for example, of the final target propulsion power, and hence a reduction in the acceleration is significantly reduced or prevented until the actual propulsion power of the marine vessel reaches the intermediate target propulsion power such that the marine vessel is promptly accelerated.

In the acceleration control system for a marine vessel according to the second preferred embodiment of the present invention, the controller is preferably configured or programmed to change the target propulsion power based on the actual propulsion power of the marine vessel and the intermediate target propulsion power. Accordingly, the target propulsion power of the marine vessel is changed based on the actual propulsion power of the marine vessel and the intermediate target propulsion power such that the influences of waves, wind, etc. changing from moment to moment are reflected in the target propulsion power based on the actual propulsion power, and hence more stable acceleration state is maintained.

In the acceleration control system for a marine vessel according to the second preferred embodiment of the present invention, the controller is preferably configured or programmed to change the target propulsion power such that the actual propulsion power of the marine vessel and the target propulsion power intersect with each other at the intermediate target propulsion power. Accordingly, overshoot of the actual propulsion power of the marine vessel from the final target propulsion power is significantly reduced or prevented.

In this case, the controller is preferably configured or programmed to change the target propulsion power such that a ratio of a difference between the intermediate target propulsion power and the target propulsion power at an initial time to the intermediate target propulsion power is equal or substantially equal to a ratio of a difference between the target propulsion power and the target propulsion power at the initial time to the actual propulsion power of the marine vessel. Accordingly, the actual propulsion power of the marine vessel and the target propulsion power are easily made to intersect with each other at the intermediate target propulsion power.

In the acceleration control system for a marine vessel according to the second preferred embodiment of the present invention, the acceleration rate of the marine vessel is preferably larger before the actual propulsion power of the marine vessel reaches the intermediate target propulsion power than after the actual propulsion power of the marine vessel reaches the intermediate target propulsion power. Accordingly, the marine vessel is promptly accelerated until the actual propulsion power of the marine vessel reaches the intermediate target propulsion power.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a marine vessel 1 including an acceleration control system 100 for a marine vessel according to a first preferred embodiment of the present invention is now described with reference to FIG. 1. In the figure, arrow FWD represents the forward movement direction of the marine vessel 1, and arrow BWD represents the reverse movement direction of the marine vessel 1. In the figure, arrow R represents the starboard direction of the marine vessel 1, and arrow L represents the portside direction of the marine vessel 1.

Figure 1:
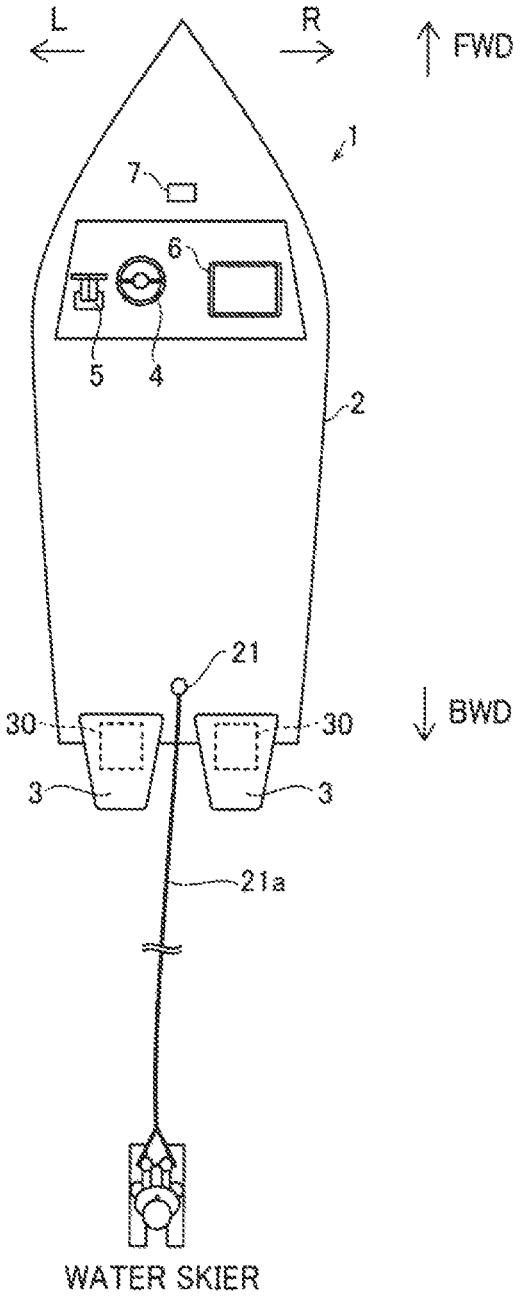
FIG. 1 is a diagram showing a marine vessel including an acceleration control system for a marine vessel according to a first preferred embodiment of the present invention.
Figures 2, 3:
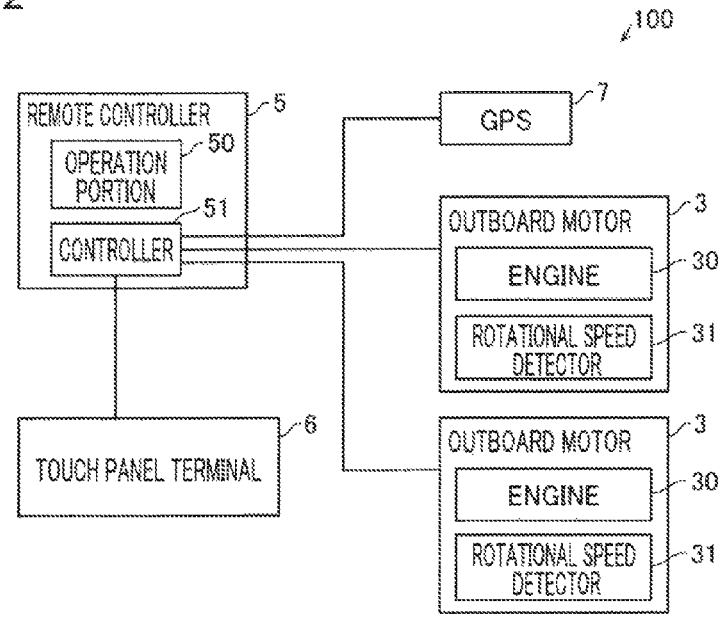
FIG. 2 is a block diagram schematically showing the acceleration control system for a marine vessel according to the first preferred embodiment of the present invention.
FIG. 3 is a table for illustrating setting an acceleration level in the acceleration control system for a marine vessel according to the first preferred embodiment of the present invention.

The marine vessel 1 includes a vessel body 2, two outboard motors 3, a steering wheel 4, a remote controller 5, a touch panel terminal 6, and a GPS (global positioning system) device 7, as shown in FIG. 1. The vessel body 2 is provided with a towing rope mounting portion 21. As shown in FIG. 2, the outboard motors 3 each include an engine 30 and a rotational speed detector 31. The remote controller 5 includes an operation portion 50 and a controller 51. The outboard motors 3 are examples of a "propulsion device" in the first preferred embodiment of the present invention, and the remote controller 5 and the operation portion 50 are examples of an "accelerator" in the first preferred embodiment of the present invention. The GPS device 7 and the rotational speed detectors 31 are examples of an "actual propulsion power detector" in the first preferred embodiment of the present invention, and the controller 51 is an example of a "setting controller" or a "controller" in the first preferred embodiment of the present invention.

As shown in FIG. 1, a first end of a towing rope 21*a* is mounted on the towing rope mounting portion 21 of the vessel body 2. A second end of the towing rope is grasped by a water skier, a wakeboarder, or the like. In other words, the marine vessel 1 tows water skis, a wakeboard, or the like.

The two outboard motors 3 are mounted on a rear portion of the vessel body 2. The outboard motors 3 extend to below the engines 30 and each include a drive shaft that transmits the drive force of the engine 30, one propeller shaft that extends in a direction orthogonal to (intersecting with) the drive shaft, and one propeller mounted on a rear end portion of the propeller shaft, rotated together with the propeller shaft. The rotational speed detectors 31 (see FIG. 2) of the outboard motors 3 detect the rotational speeds of the engines 30. The rotational speeds of the engines 30 detected by the rotational speed detectors 31 are transmitted to the controller 51.

The steering wheel 4 steers the vessel body 2 (turn the outboard motors 3). Specifically, the steering wheel 4 is connected to a turning device for the outboard motors 3. The turning device rotates the outboard motors 3 in a horizontal direction based on operation of the steering wheel.

The remote controller 5 is provided to manipulate the shifts and outputs (throttle positions) of the outboard motors 3. Specifically, the remote controller 5 is connected to the outboard motors 3. The outputs and shifts (forward movement, reverse movement, or neutral) of the engines 30 of the outboard motors 3 are controlled based on operation of the operation portion 50 of the remote controller 5. The remote controller 5 (operation portion 50) is manipulated to adjust the propulsion power including the rotational speeds of the outboard motors 3 of the marine vessel 1 or the vessel speed.

The touch panel terminal 6 is used to manipulate movement of the vessel body 2 and to select and switch a mode of the operating state of the marine vessel 1. Specifically, the touch panel terminal 6 controls the outboard motors 3 to manipulate movement of the marine vessel 1. The touch panel terminal 6 is portable, and a user operates the marine vessel 1 from an arbitrary location on the marine vessel 1 with the touch panel terminal 6 in his/her hand. The touch panel terminal 6 is a tablet terminal, for example.

The touch panel terminal 6 displays information about the marine vessel 1. The touch panel terminal 6 displays information such as the speed of the marine vessel 1, the rotational speeds of the engines 30, the remaining amount and consumed amount of fuel (gasoline), the fuel efficiency, the temperature of the engines 30, the capacity of a battery, the mode of the operating state, etc. The touch panel terminal 6 accepts selection of the mode of the operating state by the user.

The mode of the operating state includes an auto cruise mode of automatically operating the marine vessel 1, a mode of docking the marine vessel 1 and moving the marine vessel 1 away from the shore when docking the marine vessel 1 and moving the marine vessel 1 away from the shore, a trolling mode of sailing the marine vessel 1 at low speed, and a towing mode of towing water skis, a wakeboard, or the like (acceleration mode). The touch panel terminal 6 is in wired or wireless communication with the controller 51.

The GPS device 7 measures the position and speed (vessel speed) of the marine vessel 1. The position and speed of the marine vessel 1 detected by the GPS device 7 are transmitted to the controller 51. The GPS device 7 detects the actual propulsion power of the marine vessel 1.

The acceleration control system 100 for a marine vessel includes the outboard motors, the remote controller 5, the touch panel terminal 6, and the GPS device 7, as shown in FIG. 2. The acceleration control system 100 for a marine vessel controls the acceleration of the marine vessel 1 in the towing mode (acceleration mode).

According to the first preferred embodiment, the controller 51 sets the final target speed of the marine vessel 1. The controller 51 calculates the target speed of the marine vessel 1 and controls the outboard motors 3 based on the target vessel speed. Specifically, the controller 51 sets the target speed of the marine vessel 1 at an initial time to an initial target vessel speed. The controller 51 changes the target speed of the marine vessel 1 based on the actual speed of the marine vessel 1 and the initial target vessel speed. The controller 51 controls the outboard motors 3 to bring the actual speed of the marine vessel 1 closer to the final target vessel speed. The initial target vessel speed is an example of a "target propulsion power at an initial time" in the first preferred embodiment of the present invention.

The controller 51 sets the initial target vessel speed based on the final target vessel speed. Specifically, the controller 51 sets the initial target vessel speed to about ⅓ or more, for example, of the final target vessel speed. The controller 51 controls the acceleration of the marine vessel 1 when the remote controller 5 (operation portion 50) is operated not less than a threshold in the towing mode (acceleration mode). Specifically, the controller 51 starts to control the acceleration of the marine vessel 1 when the operation portion 50 is operated in the forward movement direction beyond a notch position (a state where a forward gear is selected while the engine 30 is idled) in the selected towing mode (acceleration mode). At this time, the controller 51 sets the initial target vessel speed to a value larger than a vessel speed corresponding to the threshold (notch position) in a normal mode.

The controller 51 changes the target vessel speed based on the actual speed of the marine vessel 1, the initial target vessel speed, and the final target vessel speed. Specifically, the controller 51 sets an intermediate target vessel speed that is less than the final target vessel speed based on the final target vessel speed and changes the target vessel speed based on the actual speed of the marine vessel 1, the initial target vessel speed, and the intermediate target vessel speed.

The final target vessel speed may be set by the user. The user may set the final target vessel speed in the towing mode (acceleration mode) with the touch panel terminal 6, for example. The final target rotational speeds of the engines 30 may be set instead of the final target vessel speed.

The initial target vessel speed and the intermediate target vessel speed are adjustable according to an acceleration level. As shown in FIG. 3, when the acceleration level is LOW, for example, the initial target vessel speed is preferably set to about 0.7, for example, times the final target vessel speed, and the intermediate target vessel speed is preferably set to about 0.9 times, for example, the final target vessel speed. When the acceleration level is MEDIUM, the initial target vessel speed is preferably set to about 1.0 times, for example, the final target vessel speed, and the intermediate target vessel speed is preferably set to about 0.85 times, for example, the final target vessel speed. When the acceleration level is HIGH, the initial target vessel speed is preferably set to about 1.5 times, for example, the final target vessel speed, and the intermediate target vessel speed is preferably set to about 0.8 times, for example, the final target vessel speed. In other words, as the acceleration level is increased, the initial target vessel speed is increased, and as the acceleration level is decreased, the intermediate target vessel speed is increased. The initial target vessel speed may be set to a value exceeding the final target vessel speed.

Figure 4:
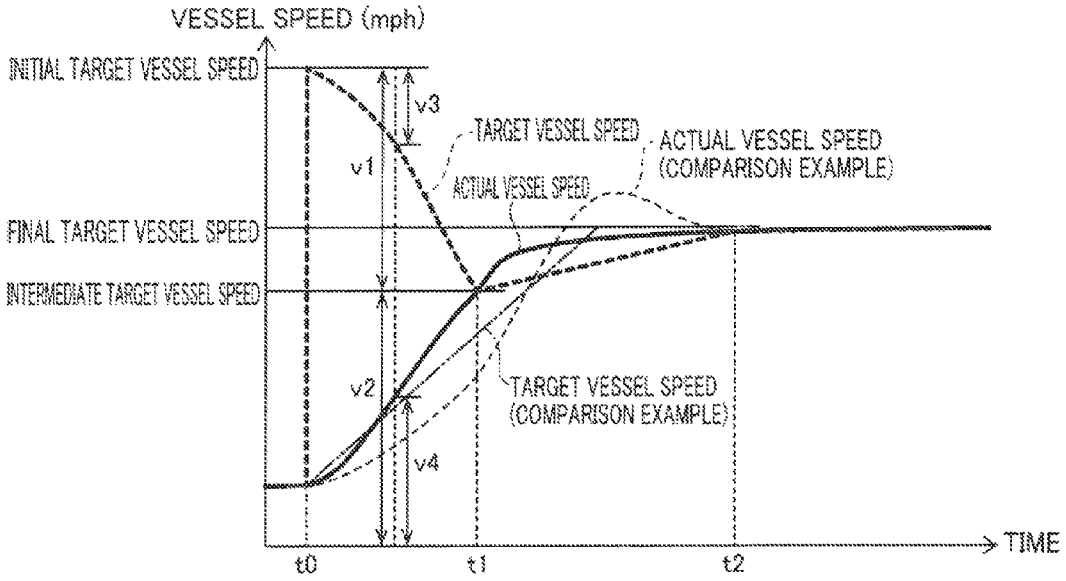
FIG. 4 is a diagram showing a first example of temporal change in a target vessel speed in the acceleration control system for a marine vessel according to the first preferred embodiment of the present invention.
Figure 5:
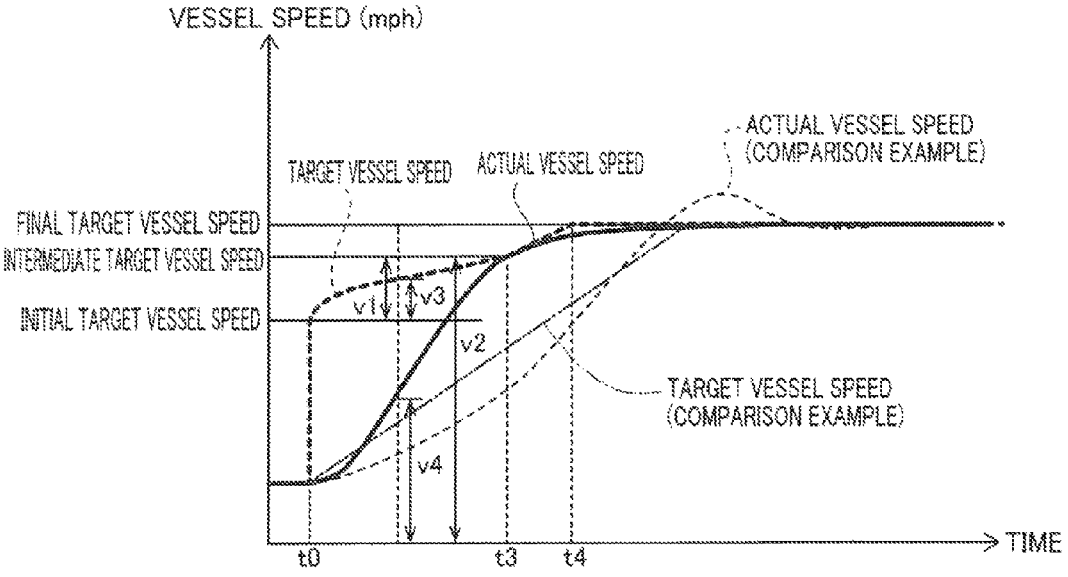
FIG. 5 is a diagram showing a second example of temporal change in the target vessel speed in the acceleration control system for a marine vessel according to the first preferred embodiment of the present invention.

The controller 51 changes the target vessel speed such that the actual speed of the marine vessel 1 and the target vessel speed intersect with each other at the intermediate target vessel speed. Specifically, the controller 51 changes the target vessel speed such that a ratio of a difference V1 between the intermediate target vessel speed and the initial target vessel speed to the intermediate target vessel speed V2 is equal or substantially equal to a ratio of a difference V3 between the target vessel speed and the initial target vessel speed to the actual speed of the marine vessel 1 (actual vessel speed) V4, as shown in FIGS. 4 and 5. In other words, the controller 51 changes the target vessel speed such that (the intermediate target vessel speed−the initial target vessel speed):the intermediate target vessel speed=(the target vessel speed−the initial target vessel speed):the actual vessel speed.

The controller 51 changes the target vessel speed based on the final target vessel speed after the actual speed of the marine vessel 1 reaches the intermediate target vessel speed. Specifically, the controller 51 gradually increases the target vessel speed from the intermediate target vessel speed toward the final target vessel speed after the actual speed of the marine vessel 1 reaches the intermediate target vessel speed. A rate at which the target vessel speed is gradually increased is adjustable according to the acceleration level. As shown in FIG. 3, when the acceleration level is LOW, for example, an increased value (an increased amount of speed per second) is preferably set to about 1.5 mph/s, for example. When the acceleration level is MEDIUM, an increased value (an increased amount of speed per second) is preferably set to about 1.0 mph/s, for example. When the acceleration level is HIGH, an increased value (an increased amount of speed per second) is preferably set to about 0.75 mph/s, for example. In other words, in the case of the high acceleration level in which the initial target vessel speed is large and the amount the actual vessel speed overshoots the intermediate target vessel speed is large, the increased value is set to be small. In the case of the low acceleration level in which the initial target vessel speed is small and the amount the actual vessel speed overshoots the intermediate target vessel speed is small, on the other hand, the increased value is set to be large.

In an example shown in FIG. 4, the acceleration level is set to HIGH. In this case, the initial target vessel speed is preferably set to about 1.5 times, for example, the final target vessel speed. In other words, the initial target vessel speed is preferably set to about ⅓ or more, for example, of the final target vessel speed. The intermediate target vessel speed is preferably set to about 0.8 times, for example, the final target vessel speed. In other words, the intermediate target vessel speed is preferably set to about ½ or more, for example, of the final target vessel speed. When acceleration in the towing mode is started at a time t0, the target vessel speed is set to the initial target vessel speed. Until a time t1 at which the actual vessel speed reaches the intermediate target vessel speed, the target vessel speed is changed such that the ratio of the difference V1 between the intermediate target vessel speed and the initial target vessel speed to the intermediate target vessel speed V2 is equal or substantially equal to the ratio of the difference V3 between the target vessel speed and the initial target vessel speed to the actual speed of the marine vessel 1 (actual vessel speed) V4. Thus, the actual vessel speed and the target vessel speed intersect with each other at the intermediate target vessel speed.

From the time t1 to a time t2, the target vessel speed is gradually increased from the intermediate target vessel speed to the final target vessel speed. In this case, the increased value (the increased amount of speed per second) is preferably set to about 0.75 mph/s, for example. Around the time t2 at which the target vessel speed reaches the final target vessel speed, the actual vessel speed also reaches the final target vessel speed. During an increase in the actual vessel speed from the intermediate target vessel speed to the final target vessel speed, a difference between the actual vessel speed and the target vessel speed is small so that the actual vessel speed does not overshoot the final target vessel speed and the marine vessel 1 is smoothly accelerated.

In a comparison example shown in FIG. 4, on the other hand, the target vessel speed is gradually increased, and hence an increase rate (acceleration rate) of the actual vessel speed in the comparison example is smaller than that in the first preferred embodiment. Furthermore, the actual vessel speed in the comparison example significantly exceeds (overshoots) the final target vessel speed. Thus, in order to reduce the actual vessel speed to the final target vessel speed, the marine vessel 1 is thereafter significantly decelerated.

In an example shown in FIG. 5, the acceleration level is set to LOW. In this case, the initial target vessel speed is preferably set to about 0.7 times, for example, the final target vessel speed. In other words, the initial target vessel speed is preferably set to about ⅓ or more, for example, of the final target vessel speed. The intermediate target vessel speed is preferably set to about 0.9 times, for example, the final target vessel speed. In other words, the intermediate target vessel speed is preferably set to about ½ or more, for example, of the final target vessel speed. When acceleration in the towing mode is started at a time t0, the target vessel speed is set to the initial target vessel speed. Until a time t3 at which the actual vessel speed reaches the intermediate target vessel speed, the target vessel speed is changed such that the ratio of the difference V1 between the intermediate target vessel speed and the initial target vessel speed to the intermediate target vessel speed V2 is equal or substantially equal to the ratio of the difference V3 between the target vessel speed and the initial target vessel speed to the actual speed of the marine vessel 1 (actual vessel speed) V4. Thus, the actual vessel speed and the target vessel speed intersect at the intermediate target vessel speed.

From the time t3 to a time t4, the target vessel speed is gradually increased from the intermediate target vessel speed to the final target vessel speed. In this case, the increased value (the increased amount of speed per second) is preferably set to about 1.5 mph/s, for example. After the time t4 at which the target vessel speed reaches the final target vessel speed, the actual vessel speed also reaches the final target vessel speed. During an increase in the actual vessel speed from the intermediate target vessel speed to the final target vessel speed, a difference between the actual vessel speed and the target vessel speed is small so that the actual vessel speed does not overshoot the final target vessel speed and the marine vessel 1 is smoothly accelerated.

In a comparison example shown in FIG. 5, on the other hand, the target vessel speed is gradually increased, and hence an increase rate (acceleration rate) of the actual vessel speed in the comparison example is smaller than that in the first preferred embodiment. Furthermore, the actual vessel speed in the comparison example significantly exceeds (overshoots) the final target vessel speed. Thus, in order to reduce the actual vessel speed to the final target vessel speed, the marine vessel 1 is thereafter significantly decelerated.

Control processing in the towing mode in the acceleration control system 100 for a marine vessel according to the first preferred embodiment is now described with reference to a flowchart in FIG. 6.

Figure 6:
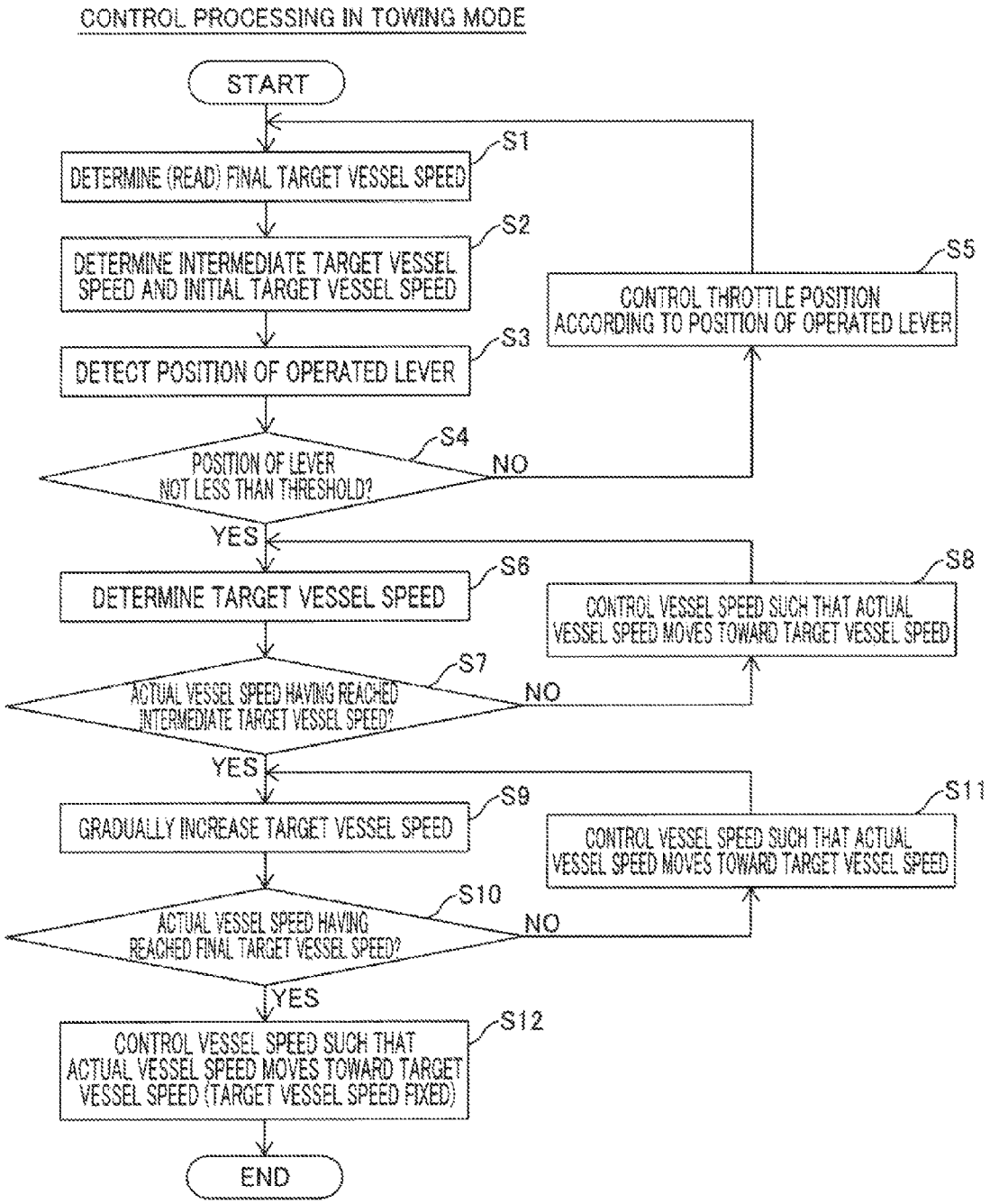
FIG. 6 is a flowchart for illustrating control processing in a towing mode in the acceleration control system for a marine vessel according to the first preferred embodiment of the present invention.

When the user selects the towing mode, the controller 51 determines (reads) the final target vessel speed at a step S1 in FIG. 6. In other words, the controller 51 determines (reads) the final target vessel speed set by the user. At a step S2, the controller 51 determines the intermediate target vessel speed and the initial target vessel speed. Specifically, the controller 51 determines the intermediate target vessel speed based on the final target vessel speed and the acceleration level both set by the user. At this time, the controller 51 determines the initial target vessel speed based on the final target vessel speed and the acceleration level both set by the user.

At a step S3, the controller 51 detects the position of an operated lever of the operation portion 50. At a step S4, the controller 51 determines whether or not the position of the operated lever of the operation portion 50 is not less than the threshold. For example, the controller 51 determines whether or not the position of the operated lever of the operation portion 50 is a position forward of the notch position. When determining that the position of the operated lever of the operation portion 50 is less than the threshold, the controller 51 advances to a step S5, and when determining that the position of the operated lever of the operation portion 50 is not less than the threshold, the controller 51 advances to a step S6.

At the step S5, the controller 51 controls the throttle positions of the engines 30 according to the position of the operated lever of the operation portion 50. Then, the controller 51 returns to the step S1.

At the step S6, the controller 51 determines the target vessel speed. Specifically, the controller 51 first sets the target vessel speed to the initial target vessel speed. Then, the controller 51 changes the target vessel speed based on the initial target vessel speed, the intermediate target vessel speed, and the actual vessel speed (the actual speed of the marine vessel 1). At this time, the target vessel speed gets closer to the intermediate target vessel speed from the initial target vessel speed. The actual vessel speed gets closer to the intermediate target vessel speed.

At a step S7, the controller 51 determines whether or not the actual vessel speed has reached the intermediate target vessel speed. When determining that the actual vessel speed has not reached the intermediate target vessel speed, the controller 51 advances to a step S8, and when determining that the actual vessel speed has reached the intermediate target vessel speed, the controller 51 advances to a step S9.

At the step S8, the controller 51 controls the vessel speed (the outputs of the engines 30) such that the actual vessel speed moves toward the target vessel speed. Then, the controller 51 returns to the step S6.

After the actual vessel speed reaches the intermediate target vessel speed, the controller 51 gradually increases the target vessel speed at the step S9. In other words, the controller 51 gradually increases the target vessel speed from the intermediate target vessel speed to the final target vessel speed by the increased value set based on the acceleration level. At a step S10, the controller 51 determines whether or not the actual vessel speed has reached the final target vessel speed. When determining that the actual vessel speed has not reached the final target vessel speed, the controller 51 advances to a step S11, and when determining that the actual vessel speed has reached the final target vessel speed, the controller 51 advances to a step S12.

At the step S11, the controller 51 controls the vessel speed (the outputs of the engines 30) such that the actual vessel speed moves toward the target vessel speed. Then, the controller 51 returns to the step S9.

After the actual vessel speed reaches the final target vessel speed, the controller 51 controls the vessel speed such that the actual vessel speed moves toward the target vessel speed (final target vessel speed) at the step S12. At this time, the controller 51 fixes the target vessel speed to the final target vessel speed. When the user cancels the towing mode, the controller 51 terminates the control processing in the towing mode.

The towing mode (acceleration mode) may be stopped halfway. When a towed water skier or wakeboarder releases the towing rope halfway, for example, the towing mode (acceleration mode) is stopped based on the operation of the user. In this case, the controller 51 compares a first target vessel speed corresponding to the operation of the remote controller 5 (operation portion 50) with a second target vessel speed calculated based on the actual speed of the marine vessel 1 and selects a smaller value of these two as the target vessel speed. In other words, after the acceleration is started in the towing mode (acceleration mode), the controller 51 compares the first target vessel speed corresponding to the operation of the user with the target vessel speed (second target vessel speed) set (changed) by the controller 51 when the user operates the operation portion 50 in a deceleration direction. When the first target vessel speed corresponding to the operation of the user is smaller than the target vessel speed (second target vessel speed) set (changed) by the controller 51, the towing mode (acceleration mode) is stopped.

In this case, the controller 51 constantly normalizes a relationship between the position of the remote controller 5 (operation portion 50) (the position of the operated remote controller 5) and the first target vessel speed according to change of the second target vessel speed such that the first target vessel speed is equal to the second target vessel speed when the remote controller 5 (operation portion 50) is placed in a wide open throttle (WOT) position. Thus, control according to the second target vessel speed is performed in the towing mode if the remote controller 5 is kept in the WOT position. When the remote controller 5 starts to return from the WOT position, the towing mode (acceleration mode) is stopped and the marine vessel 1 starts to be decelerated.

According to the first preferred embodiment of the present invention, the following advantageous effects are obtained.

According to the first preferred embodiment of the present invention, the acceleration control system 100 for a marine vessel is provided with the controller 51 configured or programmed to set the target speed of the marine vessel 1 at the initial time to the initial target vessel speed, to change the target speed of the marine vessel 1 based on the actual speed of the marine vessel 1 and the initial target vessel speed, and to control the outboard motors 3 such that the actual speed of the marine vessel 1 gets closer to the final target vessel speed. Thus, the target vessel speed is set to the initial target vessel speed in the early stage of acceleration, and hence the marine vessel 1 is promptly accelerated. Furthermore, the target speed of the marine vessel 1 is changed based on the actual speed of the marine vessel 1 and the initial target vessel speed such that the influences of waves, wind, etc. changing from moment to moment are reflected in the target vessel speed based on the actual vessel speed, and hence stable acceleration state is maintained.

According to the first preferred embodiment of the present invention, the controller 51 is configured or programmed to set the initial target vessel speed based on the final target vessel speed. Thus, the initial target vessel speed in the early stage of acceleration is set based on the final target vessel speed, and hence the marine vessel 1 is smoothly accelerated in the early stage of acceleration.

According to the first preferred embodiment of the present invention, the controller 51 is configured or programmed to set the initial target vessel speed to about ⅓ or more, for example, of the final target vessel speed. Thus, the initial target vessel speed in the early stage of acceleration is preferably set to about ⅓ or more, for example, of the final target vessel speed, and hence a reduction in the acceleration in the early stage of acceleration is significantly reduced or prevented such that the marine vessel 1 is promptly accelerated.

According to the first preferred embodiment of the present invention, the controller 51 is configured or programmed to control the acceleration of the marine vessel 1 and set the initial target vessel speed to the value larger than the vessel speed corresponding to the threshold in the normal mode, when the remote controller 5 (operation portion 50) is operated not less than the threshold in the acceleration mode. Thus, the remote controller 5 (operation portion 50) is operated not less than the threshold such that the marine vessel 1 easily starts to be accelerated in the acceleration mode and is promptly accelerated in the early stage of acceleration by setting the initial target vessel speed in the early stage of acceleration to the value larger than the vessel speed corresponding to the threshold.

According to the first preferred embodiment of the present invention, the initial target vessel speed is adjustable according to the acceleration level. Thus, when the user sets the acceleration level to be high, the initial target vessel speed in the early stage of acceleration is increased, and hence the marine vessel 1 is more promptly accelerated. When the user sets the acceleration level to be low, the initial target vessel speed in the early stage of acceleration is decreased, and hence the marine vessel 1 is relatively slowly accelerated. Consequently, when the marine vessel 1 tows water skis, a wakeboard, or the like, for example, the acceleration level is properly set such that the marine vessel 1 is accelerated and tows a water skier or wakeboarder according to the level of the water skier or wakeboarder.

According to the first preferred embodiment of the present invention, the controller 51 is configured or programmed to change the target vessel speed based on the actual speed of the marine vessel 1, the initial target vessel speed, and the final target vessel speed. Thus, the target speed of the marine vessel 1 is changed based on the actual speed of the marine vessel 1, the initial target vessel speed in the early stage of acceleration, and the final target vessel speed such that more stable acceleration state is maintained regardless of the influences of waves, wind, etc. changing from moment to moment.

According to the first preferred embodiment of the present invention, the controller 51 is configured or programmed to set the intermediate target vessel speed to less than the final target vessel speed based on the final target vessel speed and to change the target vessel speed based on the actual speed of the marine vessel 1, the initial target vessel speed, and the intermediate target vessel speed. Thus, the target vessel speed is changed also based on the intermediate target vessel speed that is less than the final target vessel speed such that the possibility that the actual speed of the marine vessel 1 becomes excessively larger than (overshoots) the final target vessel speed is significantly reduced or prevented, and hence the speed of the marine vessel 1 smoothly shifts to the final target vessel speed. Consequently, when the marine vessel 1 tows water skis, a wakeboard, or the like, for example, deceleration of the marine vessel 1 after overshoot of the speed of the marine vessel 1 from the final target vessel speed is significantly reduced or prevented, and hence release of a tension on the towed water skier or wakeboarder is significantly reduced or prevented.

According to the first preferred embodiment of the present invention, the controller 51 is configured or programmed to change the target vessel speed such that the actual speed of the marine vessel 1 and the target vessel speed intersect with each other at the intermediate target vessel speed. Thus, overshoot of the actual speed of the marine vessel 1 from the final target vessel speed is significantly reduced or prevented.

According to the first preferred embodiment of the present invention, the controller 51 is configured or programmed to change the target vessel speed such that the ratio of the difference between the intermediate target vessel speed and the initial target vessel speed to the intermediate target vessel speed is equal or substantially equal to the ratio of the difference between the target vessel speed and the initial target vessel speed to the actual speed of the marine vessel 1. Thus, the actual speed of the marine vessel 1 and the target vessel speed are easily made to intersect with each other at the intermediate target vessel speed.

According to the first preferred embodiment of the present invention, the controller 51 is configured or programmed to change the target vessel speed based on the final target vessel speed after the actual speed of the marine vessel 1 reaches the intermediate target vessel speed. Thus, the marine vessel 1 is smoothly accelerated until the actual speed of the marine vessel 1 reaches the final target vessel speed after reaching the intermediate target vessel speed.

According to the first preferred embodiment of the present invention, the intermediate target vessel speed is adjustable according to the acceleration level. Thus, when the user sets the acceleration level to be high, for example, the intermediate target vessel speed is decreased such that overshoot of the actual speed of the marine vessel 1 from the final target vessel speed is significantly reduced or prevented, and when the user sets the acceleration level to be low, for example, the intermediate target vessel speed is increased such that the marine vessel 1 is relatively slowly and smoothly accelerated.

According to the first preferred embodiment of the present invention, the controller 51 is configured or programmed to compare the first target vessel speed corresponding to the operation of the remote controller 5 (operation portion 50) with the second target vessel speed calculated based on the actual speed of the marine vessel 1 and to select the smaller value of these two as the target vessel speed. Thus, when wishing to stop the acceleration of the marine vessel 1 halfway, the user easily stops the acceleration of the marine vessel 1 by operating the remote controller 5 (operation portion 50) to make the first target vessel speed smaller than the second target vessel speed.

According to the first preferred embodiment of the present invention, the final target vessel speed is set by the user.

Thus, the user preferably sets the final target vessel speed according to the situation, and the marine vessel 1 is smoothly accelerated to the set final target vessel speed.

Second Preferred Embodiment

A second preferred embodiment of the present invention is now described with reference to FIG. 7. In the second preferred embodiment, a target vessel speed is determined based on an intermediate target vessel speed, a final target vessel speed, and the actual speed of a marine vessel, unlike the first preferred embodiment in which the target vessel speed is determined based on the initial target vessel speed, the intermediate target vessel speed, the final target vessel speed, and the actual speed of the marine vessel.

According to the second preferred embodiment of the present invention, a controller 51 (see FIG. 2) sets the intermediate target vessel speed to less than the final target vessel speed based on the final target vessel speed. The controller 51 sets the target vessel speed based on the intermediate target vessel speed until the actual speed of a marine vessel 1 (actual vessel speed) reaches the intermediate target vessel speed. The controller 51 sets the target vessel speed based on the final target vessel speed after the actual speed of the marine vessel 1 reaches the intermediate target vessel speed.

Specifically, the controller 51 sets the intermediate target vessel speed to about ½ or more, for example, of the final target vessel speed. The controller 51 sets the target vessel speed based on the intermediate target vessel speed. The controller 51 changes the target vessel speed such that the actual speed of the marine vessel 1 and the target vessel speed intersect with each other at the intermediate target vessel speed. In an example shown in FIG. 7, the target vessel speed is fixed to the intermediate target vessel speed until the actual vessel speed reaches the intermediate target vessel speed.

The acceleration rate of the marine vessel 1 is larger before the actual speed of the marine vessel 1 reaches the intermediate target vessel speed than after the actual speed of the marine vessel 1 reaches the intermediate target vessel speed. In other words, an average acceleration rate until when the actual vessel speed reaches the intermediate target vessel speed from the early stage of acceleration is larger than an average acceleration rate until when the actual vessel speed reaches the final target vessel speed from the intermediate target vessel speed. Furthermore, a maximum acceleration rate until when the actual vessel speed reaches the intermediate target vessel speed from the early stage of acceleration is larger than a maximum acceleration rate until when the actual vessel speed reaches the final target vessel speed from the intermediate target vessel speed.

Figure 7:
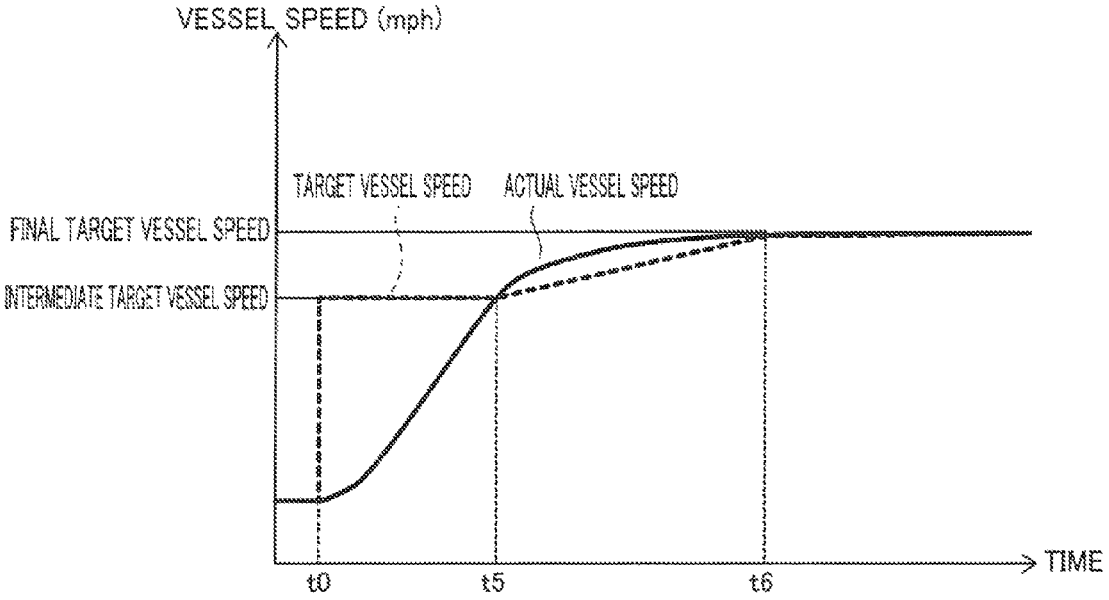
FIG. 7 is a diagram showing an example of temporal change in a target vessel speed in an acceleration control system for a marine vessel according to a second preferred embodiment of the present invention.

In the example shown in FIG. 7, the intermediate target vessel speed is preferably set to about ½ or more, for example, of the final target vessel speed. When acceleration in a towing mode is started at a time t0, the target vessel speed is set to the intermediate target vessel speed. Until a time t5 at which the actual vessel speed reaches the intermediate target vessel speed, the target vessel speed is fixed to the intermediate target vessel speed. Thus, the actual vessel speed and the target vessel speed intersect with each other at the intermediate target vessel speed.

From the time t5 to a time t6, the target vessel speed is gradually increased from the intermediate target vessel speed to the final target vessel speed. Around the time t6 at which the target vessel speed reaches the final target vessel speed, the actual vessel speed also reaches the final target vessel speed. During an increase in the actual vessel speed from the intermediate target vessel speed to the final target vessel speed, a difference between the actual vessel speed and the target vessel speed is small so that the actual vessel speed does not overshoot the final target vessel speed and the marine vessel 1 is smoothly accelerated.

The remaining structure of the second preferred embodiment is preferably similar to that of the above first preferred embodiment.

According to the second preferred embodiment of the present invention, the following advantageous effects are obtained.

According to the second preferred embodiment of the present invention, an acceleration control system for a marine vessel is provided with the controller 51 configured or programmed to set the intermediate target vessel speed to less than the final target vessel speed based on the final target vessel speed, to set the target vessel speed based on the intermediate target vessel speed until the actual speed of the marine vessel 1 reaches the intermediate target vessel speed, and to set the target vessel speed based on the final target vessel speed after the actual speed of the marine vessel 1 reaches the intermediate target vessel speed. Thus, the target vessel speed is set based on the intermediate target vessel speed that is less than the final target vessel speed such that the possibility that the actual speed of the marine vessel 1 becomes excessively larger than (overshoots) the final target vessel speed is significantly reduced, similarly to the first preferred embodiment. Therefore, the marine vessel 1 is promptly accelerated, and the speed of the marine vessel 1 smoothly shifts to the final target vessel speed.

The remaining effects of the second preferred embodiment are similar to those of the above first preferred embodiment.

The preferred embodiments of the present invention described above are illustrative in all points and not restrictive. The extent of the present invention is not defined by the above description of the preferred embodiments but by the scope of claims, and all modifications within the meaning and range equivalent to the scope of claims are further included.

For example, while the setting controller and the controller according are preferably integral in the remote controller in each of the first and second preferred embodiments described above, the present invention is not restricted to this. According to a preferred embodiment of the present invention, the setting controller and the controller may alternatively be provided separately from each other, or the setting controller and the controller may alternatively be provided in a device other than the remote controller.

While the vessel speed is preferably controlled as the propulsion power of the marine vessel in each of the first and second preferred embodiments described above, the present invention is not restricted to this. According to a preferred embodiment of the present invention, the rotational speeds of the propulsion devices may alternatively be controlled as the propulsion power of the marine vessel, for example.

While the outboard motors are preferably used as the propulsion devices of the marine vessel in each of the first and second preferred embodiments described above, the present invention is not restricted to this. According to a preferred embodiment of the present invention, inboard motors, jet propulsion devices, or the like may alternatively be used as the propulsion devices of the marine vessel, for example. The propulsion devices may be engine propulsion devices, electric motor propulsion devices, or hybrid propulsion devices of engines and electric motors.

While two outboard motors (propulsion devices) are preferably provided in the marine vessel in each of the first and second preferred embodiments described above, the present invention is not restricted to this. According to a preferred embodiment of the present invention, one or three or more propulsion devices may alternatively be provided in the marine vessel.

While the acceleration control system for a marine vessel that controls the acceleration of the marine vessel when the marine vessel tows water skis, a wakeboard, or the like is shown in each of the first and second preferred embodiments described above, the present invention is not restricted to this. According to a preferred embodiment of the present invention, the acceleration control system for a marine vessel may alternatively control the acceleration of the marine vessel other than during towing.

While the actual speed of the marine vessel is preferably acquired (measured) by the GPS device in each of the first and second preferred embodiments described above, the present invention is not restricted to this. According to a preferred embodiment of the present invention, the actual speed of the marine vessel may alternatively be measured by a device other than the GPS device. For example, the actual speed of the marine vessel may be measured from a difference between static pressure and dynamic pressure by a pitot tube, or the actual speed of the marine vessel may be measured from the number of rotations of a water wheel by a water wheel device.

While the controller is preferably configured or programmed to control the acceleration of the marine vessel when the accelerator is operated not less than the threshold in the acceleration mode in each of the first and second preferred embodiments described above, the present invention is not restricted to this. According to a preferred embodiment of the present invention, the controller may alternatively be configured or programmed to start control of the acceleration of the marine vessel based on another trigger in the acceleration mode. For example, the controller may be configured or programmed to start control of the acceleration of the marine vessel by operation of a button.

While the target vessel speed is preferably fixed to the intermediate target vessel speed until the actual speed of the marine vessel reaches the intermediate target vessel speed in the second preferred embodiment described above, the present invention is not restricted to this. According to a preferred embodiment of the present invention, the target vessel speed may alternatively be changed until the actual speed of the marine vessel reaches the intermediate target vessel speed.

While the processing operations performed by the controller are described using a flowchart in a flow-driven manner in which processing is performed in order along a processing flow for the convenience of illustration in the first preferred embodiment described above, the present invention is not restricted to this. According to a preferred embodiment of the present invention, the processing operations performed by the controller may alternatively be performed in an event-driven manner in which processing is performed on an event basis. In this case, the processing operations performed by the controller may be performed in a complete event-driven manner or in a combination of an event-driven manner and a flow-driven manner.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An acceleration control system for a marine vessel, the acceleration control system comprising:

an actual propulsion power detector that detects an actual value of propulsion power including a rotational speed of a propulsion device of the marine vessel or a speed of the marine vessel;

a setting controller that sets a final target propulsion power of the marine vessel; and a controller configured or programmed to calculate a target propulsion power of the marine vessel and to control the propulsion device based on the target propulsion power; wherein the controller is configured or programmed to set the target propulsion power of the marine vessel at an initial time to an initial target propulsion power, to change the target propulsion power of the marine vessel based on an actual propulsion power of the marine vessel and the initial target propulsion power, and to control the propulsion device such that the actual propulsion power of the marine vessel gets closer to the final target propulsion power; and the controller is configured or programmed to set the initial target propulsion power to about ⅓ or more of the final target propulsion power.

2. The acceleration control system for a marine vessel according to claim 1, wherein the controller is configured or programmed to set the initial target propulsion power based on the final target propulsion power.

3. The acceleration control system for a marine vessel according to claim 1, further comprising an accelerator that is manipulated to adjust the propulsion power of the marine vessel; wherein the controller is configured or programmed to control acceleration of the marine vessel and sets the initial target propulsion power to a value larger than a propulsion power corresponding to a threshold in a normal mode when the accelerator is operated not less than the threshold in an acceleration mode.

4. The acceleration control system for a marine vessel according to claim 1, wherein the initial target propulsion power is adjusted according to an acceleration level.

5. The acceleration control system for a marine vessel according to claim 1, wherein the controller is configured or programmed to change the target propulsion power based on the actual propulsion power of the marine vessel, the initial target propulsion power, and the final target propulsion power.

6. The acceleration control system for a marine vessel according to claim 5, wherein the controller is configured or programmed to set an intermediate target propulsion power to less than the final target propulsion power based on the final target propulsion power and to change the target propulsion power based on the actual propulsion power of the marine vessel, the initial target propulsion power, and the intermediate target propulsion power.

7. The acceleration control system for a marine vessel according to claim 6, wherein the controller is configured or programmed to change the target propulsion power such that the actual propulsion power of the marine vessel and the target propulsion power intersect with each other at the intermediate target propulsion power.

8. The acceleration control system for a marine vessel according to claim 7, wherein the controller is configured or programmed to change the target propulsion power such that a ratio of a difference between the intermediate target propulsion power and the initial target propulsion power to the intermediate target propulsion power is equal or substantially equal to a ratio of a difference between the target propulsion power and the initial target propulsion power to the actual propulsion power of the marine vessel.

9. The acceleration control system for a marine vessel according to claim 6, wherein the controller is configured or programmed to change the target propulsion power based on the final target propulsion power after the actual propulsion power of the marine vessel reaches the intermediate target propulsion power.

10. The acceleration control system for a marine vessel according to claim 6, wherein the intermediate target propulsion power is adjusted according to an acceleration level.

11. The acceleration control system for a marine vessel according to claim 1, further comprising an accelerator that is manipulated to adjust the propulsion power of the marine vessel; wherein the controller is configured or programmed to compare a first target propulsion power corresponding to an operation of the accelerator with a second target propulsion power calculated based on the actual propulsion power of the marine vessel, and to select a smaller value of the first target propulsion power and the second target propulsion power as the target propulsion power.

12. The acceleration control system for a marine vessel according to claim 1, wherein the final target propulsion power is set by a user.

13. An acceleration control system for a marine vessel, the acceleration control system comprising:

an actual propulsion power detector that detects an actual value of a propulsion power including a rotational speed of a propulsion device of the marine vessel or a speed of the marine vessel;

a setting controller configured or programmed to set a final target propulsion power of the marine vessel; and a controller configured or programmed to calculate a target propulsion power of the marine vessel and to control the propulsion device based on the target propulsion power; wherein the controller is configured or programmed to set an intermediate target propulsion power to less than the final target propulsion power based on the final target propulsion power, to set the target propulsion power based on the intermediate target propulsion power until an actual propulsion power of the marine vessel reaches the intermediate target propulsion power, and to set the target propulsion power based on the final target propulsion power after the actual propulsion power of the marine vessel reaches the intermediate target propulsion power; and the controller is configured or programmed to set the intermediate target propulsion power to about ½ or more of the final target propulsion power.

14. The acceleration control system for a marine vessel according to claim 13, wherein the controller is configured or programmed to change the target propulsion power based on the actual propulsion power of the marine vessel and the intermediate target propulsion power.

15. The acceleration control system for a marine vessel according to claim 13, wherein the controller is configured or programmed to change the target propulsion power such that the actual propulsion power of the marine vessel and the target propulsion power intersect with each other at the intermediate target propulsion power.

16. The acceleration control system for a marine vessel according to claim 15, wherein the controller is configured or programmed to change the target propulsion power such that a ratio of a difference between the intermediate target propulsion power and the target propulsion power at an initial time to the intermediate target propulsion power is equal or substantially equal to a ratio of a difference between the target propulsion power and the target propulsion power at the initial time to the actual propulsion power of the marine vessel.

17. The acceleration control system for a marine vessel according to claim 13, wherein an acceleration rate of the marine vessel is larger before the actual propulsion power of the marine vessel reaches the intermediate target propulsion power than after the actual propulsion power of the marine vessel reaches the intermediate target propulsion power.

* * * * *